US005167297A

United States Patent [19]

Stevenson

[11] Patent Number: 5,167,297

[45] Date of Patent: Dec. 1, 1992

[54] STAIRWAY SAFETY RAIL AND BELT ATTACHMENT

[76] Inventor: Charles Stevenson, 1805 Thomas Ave., Baltimore, Md. 21216

[21] Appl. No.: 698,732

[22] Filed: May 10, 1991

[51] Int. Cl.[5] ..... A62B 35/00

[52] U.S. Cl. ..... 182/3; 182/129

[58] Field of Search ..... 182/3, 5, 6, 7, 8, 9, 182/4; 119/96

[56] References Cited

U.S. PATENT DOCUMENTS

| | | | |
|---|---|---|---|
| 1,490,066 | 4/1924 | Carr | 182/3 |
| 3,439,775 | 4/1969 | Henrie | 182/138 |
| 3,491,726 | 1/1970 | Partin | 119/96 |
| 3,992,832 | 11/1976 | Ferwerda | 52/184 |
| 4,253,287 | 3/1981 | Overmoe | 52/184 |
| 4,256,098 | 3/1981 | Swap | 128/133 |
| 4,303,041 | 12/1981 | Thompson | 119/96 |
| 4,478,311 | 10/1984 | Anderson | 182/3 |
| 4,638,764 | 1/1987 | Anderson | 119/96 |
| 4,674,596 | 6/1987 | Weiner | 182/3 |
| 4,823,524 | 4/1989 | Bednar | 182/106 |
| 4,923,048 | 5/1990 | Cole | 182/9 |

FOREIGN PATENT DOCUMENTS

| | | | |
|---|---|---|---|
| 698627 | 11/1979 | U.S.S.R. | 182/3 |

*Primary Examiner*—Reinaldo P. Machado
*Attorney, Agent, or Firm*—Charles F. Obrecht, Jr.

[57] ABSTRACT

A safety device for a stairway or other inclined surface includes a rail and a safety belt. The safety belt is wrapped around the rail to form a noose. The noose allows the safety belt to move freely along the rail when a person is not falling and prevents the safety belt from moving along the rail when a person is falling.

15 Claims, 2 Drawing Sheets

STAIRWAY SAFETY RAIL AND BELT ATTACHMENT

BACKGROUND OF THE INVENTION

The invention is in the field of safety devices for stairways or other inclined structures. More specifically, the invention relates to a safety belt and rail which prevents a person from falling down a stairway or other inclined structure.

Each year thousands of senior citizens are injured from falls on stairways in their homes and in other places. Several conventional devices have been developed in order to reduce the number of injuries resulting from ascending or descending a stairway.

For example, U.S. Pat. No. 3,992,832, issued Nov. 23, 1976 to Ferwerda, discloses a stairway safety suspension support apparatus. This apparatus provides a plurality of loops along the stairway which a person can grasp in the event of a fall. Unfortunately, this apparatus is not passive. That is, some positive action is required by the user in order to prevent the user from falling.

U.S. Pat. No. 4,253,287, issued Mar. 3, 1981 to Overmoe, discloses a step walker for use in conjunction with a stairway. In this apparatus, a walking bar is temporarily positioned within guide slots as the person walks up or down the stairway. Unfortunately, this apparatus relies on the user to move the walking bar as well as to hold on to the walking bar in order to prevent himself or herself from falling.

U.S. Pat. No. 3,439,775, issued Apr. 22, 1969 to Henrie et al., discloses a safety device for a stairway. In this device, a barrier, such as a net, is used to catch a person during his or her fall. This invention has the disadvantage of catching a person only after he or she has fallen some distance.

The devices discussed above have the disadvantages of either requiring positive action by the user in order to prevent the user from falling or catching a user only after he or she has fallen some distance.

Thus, there is a need for a passive device which will prevent falls while using a stairway.

SUMMARY OF THE INVENTION

It is an object of the invention, therefore, to provide a device which will prevent falls on a stairway or other inclined structure.

Another object of the invention is to provide a stairway safety device which does not rely on positive action of a user.

Another object of the invention is to provide a stairway safety device which will restrain a person from falling before the person falls any significant distance, rather than catching the person after he or she has fallen.

A further object of the invention is to provide a safety device for a stairway or other inclined structure which is simple and inexpensive.

With the above considerations in mind, according to a first aspect of the invention, there is provided a safety device which includes a rail and a safety belt. The safety belt has a first portion capable of being wrapped around a person and a second portion forming a noose around the rail. The noose opens slightly to allow the safety belt to move freely along the rail when the person is not falling and closes to prevent the safety belt from moving freely along the rail when the person is falling.

BRIEF DESCRIPTION OF THE DRAWINGS

The invention is described below with reference to the accompanying drawings, wherein:

In FIG. 2, the safety belt is not shown.

DETAILED DESCRIPTION OF THE PREFERRED EMBODIMENTS

The invention provides for safe passage up and down a stairway without the possibility of falling forward while descending or falling backward while ascending the stairway. The invention is designed to prevent, or hold, a person from falling rather than catching a person after he or she has fallen some distance.

Figure 1:
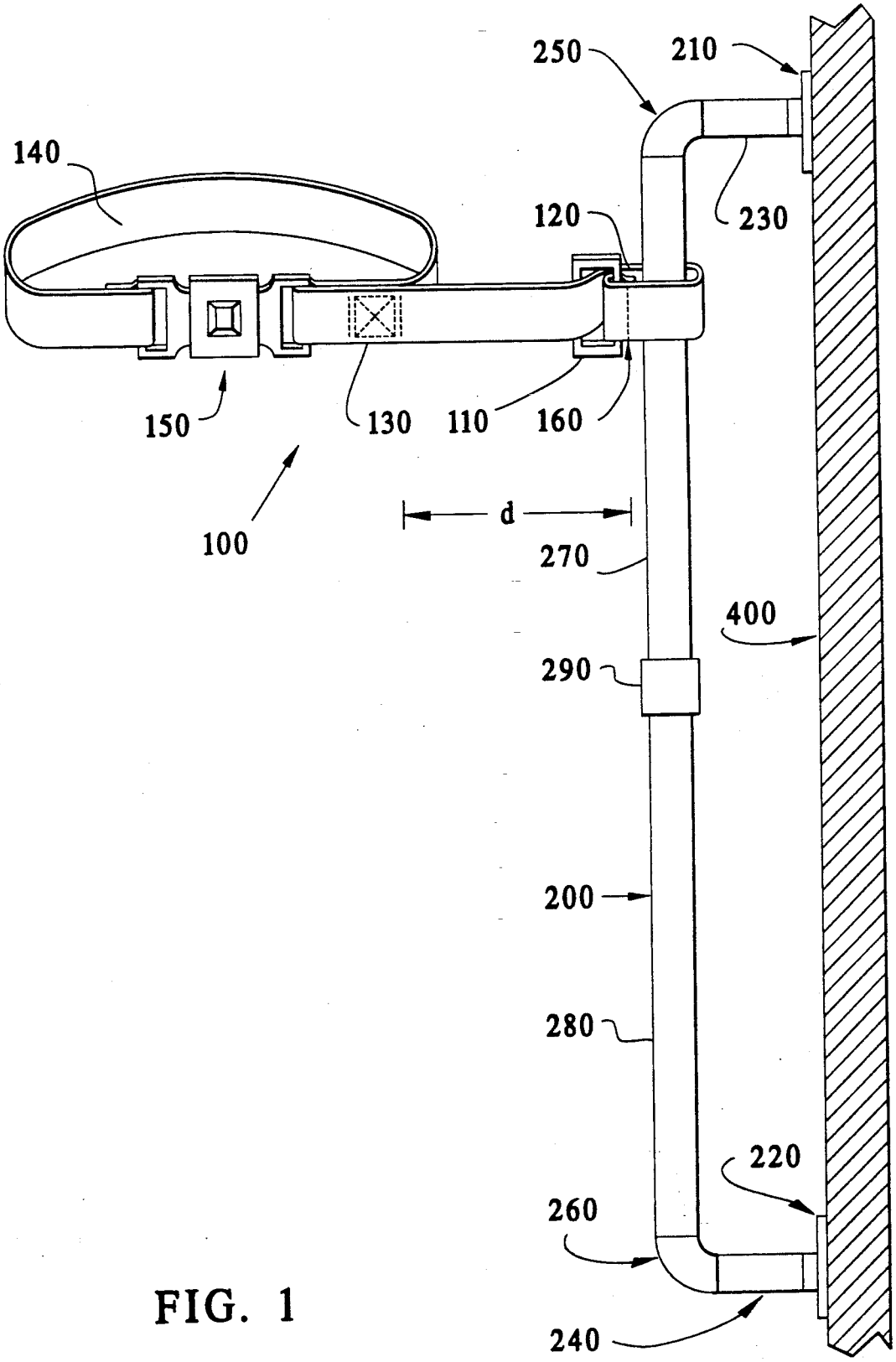
FIG. 1 illustrates a rail and safety belt according to a preferred embodiment of the instant invention.
Figure 2:
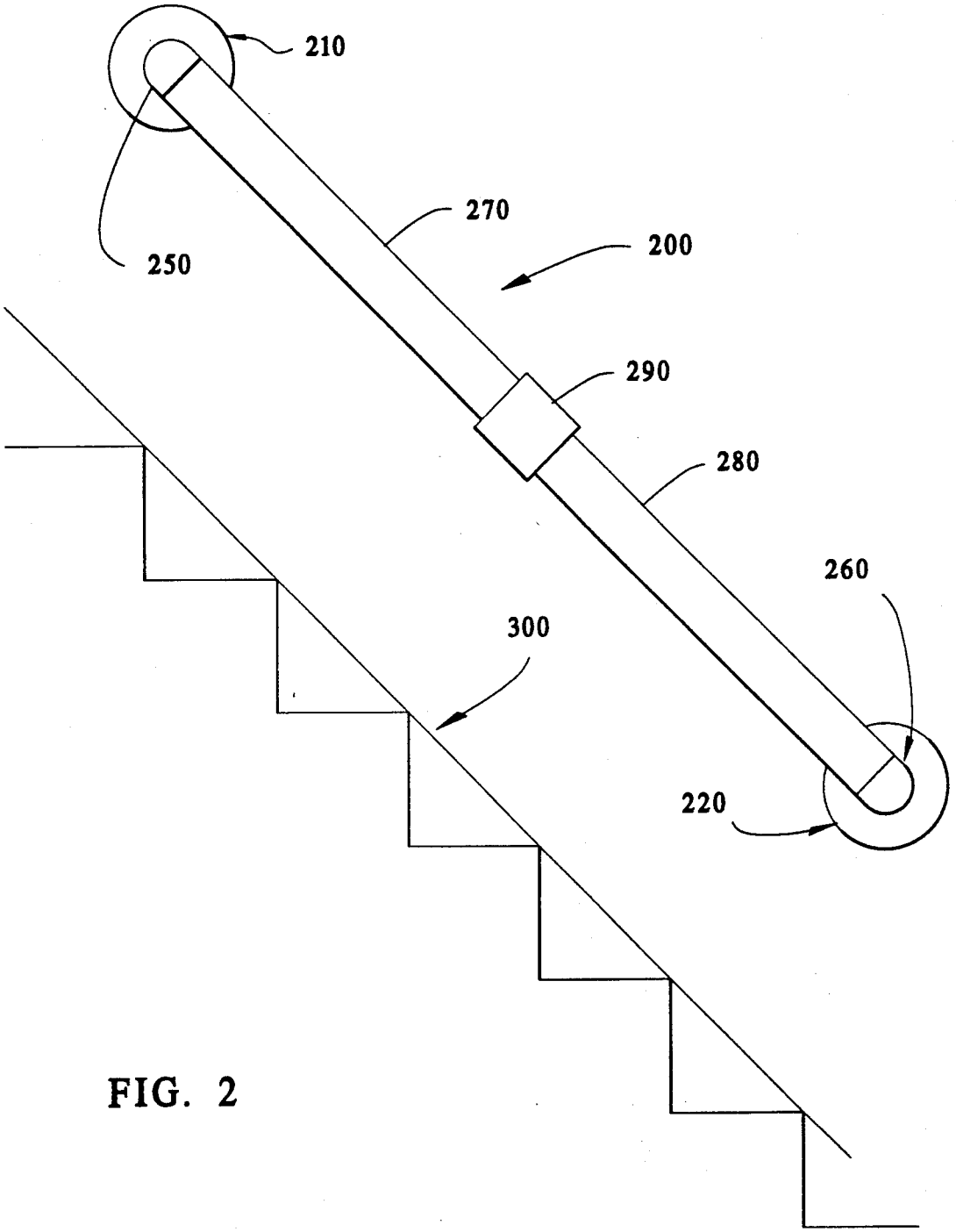
FIG. 2 illustrates the rail of FIG. 1 and a stairway.

FIGS. 1 and 2 illustrate a preferred embodiment of the invention. As illustrated in FIG. 2, a rail 200 is provided adjacent to a stairway 300. In the preferred embodiment, the rail is formed from two sections of ¾" or 1" metal pipe 270 and 280. The two sections of pipe are joined by a 1½" coupling 290. Alternatively, the rail can be formed from a single section of pipe or from more than two sections of pipe. Elbows 250 and 260 are located at the ends of the pipe sections. Attached to the elbows 250 and 260 are nipples 230 and 240, respectively. The nipples 230 and 240 are secured to a stationary member, such as a wall 400 using flanges 210 and 220, respectively. The flanges are secured to the wall 400 using bolts, screws, or other suitable fasteners. Since the rail will be subject to a portion of a person's weight while the rail is holding the person, it is important that the flanges 210 and 220 be secured to the wall 400 such that the flanges can withstand several hundred pounds of force. In the preferred embodiment, the rail also serves as a hand rail.

A safety belt 100 is attached to the rail 200 as illustrated in FIG. 1. The end of the safety belt 100 is attached to a metal belt lock 110. The metal belt lock 110 may be fabricated out of any structural material capable of withstanding several hundred pounds of force. In the preferred embodiment, the metal belt lock is generally O-shaped.

The safety belt comprises a single member, having a stitched area 130 forming a loop for the buckel 150 and a continuous strap 140 to attach to the buckel 150 at one end, and further attaching the other end of the single member to its lock 110 having an opening with the safety belt passing through said opening to form a noose 120 around the rail 200 as shown in FIG. 1.

The portion of the continuous strap leading from the loop around the buckel 150 formed by the stitched area 130 to the other end of the buckle 150, is designed to wrap around a person and includes a buckle 150 in order to allow the user to get into and out of said portion of the continuous strap.

The safety belt can be constructed of any material sufficient to support several hundred pounds. In the preferred embodiment, the safety belt is 1½" wide and has a generally rectangular cross section, similar to an automotive seat belt. In the preferred embodiment, the buckle 150 is similar to an automotive seat belt buckle.

The distance d between the stitching 130 and the noose portion of the safety belt should be minimized for reasons that will be discussed below. In the preferred embodiment, this distance is approximately 8". Operation of the preferred embodiment will now be described.

The user places that portion of the continuous strap 140 leading from the loop around the buckle 150 formed by the stitched area 130 to the other end of the buckle 150 around himself or herself by unlatching and latching the buckle 150. When the user ascends or descends the stairway, the noose portion of the safety belt is slightly open. The noose glides freely over the rail 200 because the user exerts very little force on the noose portion of the safety belt.

In the event that the user begins to fall while ascending or descending the stairway, the user will exert force on the noose portion of the safety belt. This force will cause the noose portion of the safety belt to close and grip the rail 200. The friction formed between the safety belt and the rail prevents, or inhibits, the safety belt from moving along the rail. Thus, as soon as the person begins to fall, the safety belt grips the rail and holds, or prevents, the person from falling.

The rectangular cross-section of the belt maximizes the area of contact between the belt and the rail and thus maximizes the holding force between the belt and the rail. Rubber pads or another material having a high coefficient of friction can be added on the inner portion of the noose to increase friction, if necessary.

The degree to which a person is permitted to fall prior to being stopped by the safety belt depends upon distance d, which is the distance between the stitching 130 and the noose portion 120 of the safety belt. Accordingly, this distance should be minimized.

As evident from the description above, the instant invention is easy to construct and easy to use. This simple construction makes the instant invention far more affordable than more complicated devices.

In the preferred embodiment, the belt is normally stored on the rail when the belt is not being used. When the belt is stored on the rail, for example, near the top of the stairway, the weight of the belt itself provides enough force on the rail to prevent the belt from sliding down the rail. If necessary, slight protrusions or bumps can be provided every several inches along the rail to prevent the belt from sliding down the rail when the belt is not in use. These bumps can be formed by, for example, welding a small amount of metal to the rail.

The foregoing description has been set forth merely to illustrate a preferred embodiment of the invention and is not intended to be limiting. Since modification of the described embodiment incorporating the spirit and substance of the invention may occur to persons skilled in the art, the scope of the invention should be limited solely with respect to the appended claims and equivalents.

What is claimed is:

1. A safety device, comprising:

a single member safety belt having opposite ends and having a stitched area between said ends forming a portion for attachment to a buckle, said single member attached to said buckle at one end, the other end of the belt attached to a lock having an opening for passing said belt through to form a noose, said single member being for wrapping around a person and said noose being for wrapping around a rail connected to a stationary member, said noose opening to allow said safety belt to move along said rail when said person is not falling and closing to prevent said safety belt from moving along said rail when said person is falling.

2. A safety device as set forth in claim 1, wherein said safety belt has a rectangular cross section.

3. A safety device is set forth in claim 2, wherein said opening in said lock has a rectangular shape.

4. An apparatus, comprising:

a stairway;

a rail connected to a stationary member and located adjacent to said stairway; and a single member safety belt having opposite ends and having a stitched area between said ends forming a portion for attachment to a buckle, said single member attached to said buckle at one end, the other end of the belt attached to a lock having an opening for passing said belt through to form a noose, said single member being for wrapping around a person and said noose being for wrapping around said rial, said noose opening to allow said safety belt to move freely along said rail when sail person is not falling and closing to prevent said safety belt from moving along said rail when said person is falling.

5. An apparatus as set forth in claim 4, wherein said safety belt has a rectangular cross section.

6. An apparatus as set forth in claim 5, wherein said opening in said lock has a rectangular shape.

7. An apparatus comprising:

an inclined surface;

a rail connected to a stationary member and located adjacent to said inclined surface; and a single member safety belt having opposite ends and having a stitched area between said ends forming a portion for attachment to a buckle, said single member attached to said buckle at one end, the other end of the belt attached to a lock having an opening for passing said belt through to form a noose, said single member being for wrapping around a person and said noose being for wrapping around said rail, said noose opening to allow said belt to move freely along said rail when said person is not falling and closing to prevent said safety belt from moving along said rail when said person is falling.

8. An apparatus as set forth in claim 7, wherein said safety belt has a rectangular cross section.

9. An apparatus as set forth in claim 8, wherein said opening in said lock has a rectangular shape.

10. A method of preventing a person from falling, comprising the steps of:

wrapping a single member safety belt having opposite ends around said person; said safety belt having a stitched area between said ends forming a portion for attachment to a buckle, said single member attached to said buckle at an end, the other end of said belt attached to a lock having an opening for passing said belt through to form a noose, said single member being for wrapping around said person; and wrapping said noose around a rail connected to a stationary member; and when said person is falling, exerting force on said noose to cause friction between said safety belt and said rail sufficient to inhibit said safety belt from moving along the rail.

11. A method of preventing a person from falling down a stairway, comprising the steps of:

locating a rail adjacent to said stairway and connecting said rail to a stationary member;

wrapping a single member safety belt having opposite ends around said person; said safety belt having a stitched area between said end forming a portion for attachment to a buckle, said single member attached to said buckle at an end, the other end of said belt attached to a lock having an opening for passing said belt through to form a noose, said single member being for wrapping around said person; and wrapping said noose around a rail connected to a stationary member; and when said person is falling, exerting force on said noose to cause friction between said safety belt and said rail sufficient to inhibit said safety belt from moving along the rail.

12. A method of preventing a person from falling down an inclined surface, comprising the steps of:

locating a rial adjacent to said inclined surface and connecting said rail to a stationary member;

wrapping a single member safety belt having opposite ends around said person; said safety belt having a stitched area between said ends forming a portion for attachment to a buckle, said single member attached to said buckle at an end, the other end of said belt attached to a lock having an opening for passing said belt through to form a noose, said single member being for wrapping around said person; and wrapping said noose around a rail connected to a stationary member; and when said person is falling, exerting force on said noose to cause friction between said safety belt and said rail sufficient to inhibit said safety belt from moving along the rail.

13. A safety device comprising:

a hand rail connected to a stationary member; and a single member safety belt having opposite ends and having a stitched area between said ends forming a portion for attachment to a buckle, said single member attached to said buckle at an end, the other end of the belt attached to a lock having an opening for passing said belt through to form a noose, said single member being for wrapping around a person and said noose being for wrapping around said hand rail, said noose opening to allow said safety belt to move along said hand rail when said person is not falling and closing to prevent said safety belt from moving along said hand rail when said person is falling.

14. A safety device as set forth in claim 13, wherein said safety belt has a rectangular cross section.

15. A safety device as set forth in claim 14, wherein said opening in said lock has a rectangular shape.

* * * * *